United States Patent [19]

Smal

[11] 4,061,381

[45] Dec. 6, 1977

[54] TWIST PREVENTION DEVICE

[75] Inventor: Henri Smal, Oupeye, Belgium

[73] Assignee: Societe Anonyme FACO, Oupeye, Belgium

[21] Appl. No.: 704,949

[22] Filed: July 13, 1976

[30] Foreign Application Priority Data

July 18, 1975 Belgium ..... 645098

[51] Int. Cl.[2] ..... H01R 39/00

[52] U.S. Cl. ..... 339/8 P; 339/101; 339/182 RS

[58] Field of Search ..... 339/8 P, 8 R, 8 PB, 339/101, 182 RS

[56] References Cited

U.S. PATENT DOCUMENTS 2,645,759 7/1953 Solari ..... 339/8 P

*Primary Examiner*—Roy Lake
*Assistant Examiner*—DeWalden W. Jones
*Attorney, Agent, or Firm*—Martin A. Farber

[57] ABSTRACT

A twist-prevention device comprising two connecting members, respectively, for the incoming and outgoing current, mounted such that they can rotate relative to one another. The connecting members have a stepped section so as to permit easy assembly and disassembly relative to each another, and the connecting member for the incoming current is provided with annular contact strips or cable shoes which are connected to a power supply and located in stepped manner with respect to the axis of the member, whereas the connecting member for the outgoing current is provided with helically wound conductors also arranged in stepped manner on the steps of the member to separately make contact with the corresponding stepped cable shoes.

6 Claims, 5 Drawing Figures

FIG.1
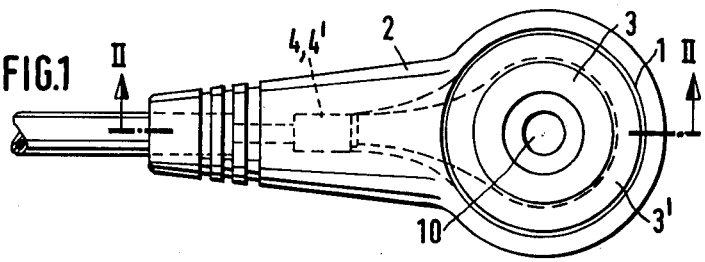
FIG.2
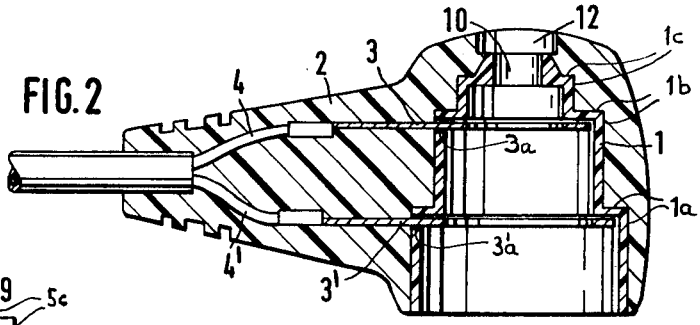
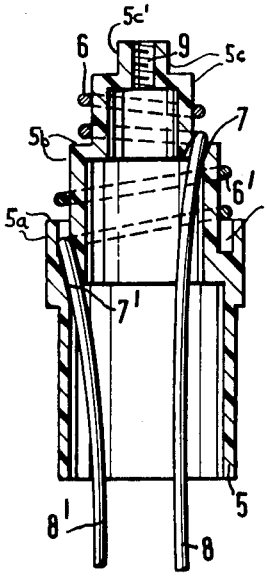
FIG.3
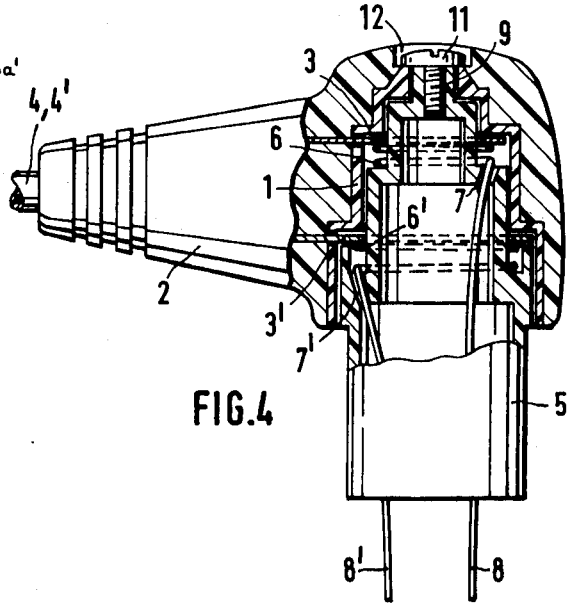
FIG.4

TWIST PREVENTION DEVICE

The present invention relates to a twist-prevention device for electrical conductors.

In particular, the present invention relates to a twist-prevention device for the electrical connection of appliances, such as curling tongs, electric shavers and the like, the electrical conductors of which rapidly and easily twist as a result of the large amount of movement and manipulation which the appliance undergoes.

Rotary connectors are already known which effectively prevent the electrical conductors from twisting, but they are expensive to construct and there are sometimes homologation difficulties.

It is an object of the present invention to provide an effective twist-prevention device which avoids the above-mentioned disadvantages.

It is another object of the present invention to provide a twist-prevention device for an electrical connection comprising a rotary connector which can be molded on in one piece.

A twist-prevention device or rotary connector according to the present invention comprises two connecting members, respectively, for the incoming and outgoing current, mounted such that they can rotate relative to one another. The device in accordance with the invention is characterized in that the connecting members have a stepped section so as to permit easy assembly and disassembly relative to each other, and further in that the connecting member for the incoming current is provided with annular contact strips or laterally extending pear-shaped cable shoes which are connected to a power supply and are located in stepped manner with respect to the axis of the member, whereas the connecting member for the outgoing current is provided with helically wound conductors constituting simply spring wires also arranged in stepped manner on the wider steps of the member to separately make contact with the corresponding stepped annular contact strip portions of the cable shoes.

With the above and other objects in view, the present invention will become more clearly understood in connection with the following detailed description of preferred embodiment examples of the invention, in connection with the accompanying drawings, of which:

FIG. 1 is a plan view from the bottom of the female member of a twist-preventing device according to the invention, without the connecting member for the outgoing current;

FIG. 2 a section along the line II—II of FIG. 1;

FIG. 3 a section through the male connecting member for the outgoing current of a twist-prevention device according to the invention;

FIG. 4 is a section identical to that of FIG. 2, but showing the complete assembled twist-prevention device.

Figure 3A:
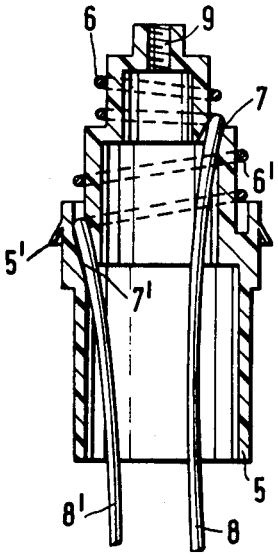
FIG. 3A is a view similar to FIG. 3 but showing a variant embodiment.

Referring now to the drawings, and more particularly to FIGS. 1 and 2, a twist-prevention device according to the invention comprises inter alia a female connecting member or sleeve 1 for receiving the incoming current, which is molded from a suitable plastic material into a body 2 in order to form a bendable connector.

The member 1 includes the sleeve 1 which has stepped interior sections forming steps 1*a*, 1*b*, 1*c* as may be noted from FIG. 2. The upper portions of the two steps 1*a* and 1*b* are formed with cable shoe openings 3*a* and 3'*a* for insertion therein into the interior of the sleeve 1 of the annular contact portions or strips of the pear-shaped cable shoes 3 and 3', respectively, which include laterally elongated neck portions which are respectively connected to the cables 4 and 4' to the power supply at a lateral position remote from the stepped interior sections of the member 1.

The annular contact portions of the cable shoes 3 and 3' are stepped offset corresponding to the steps 1*b* and 1*a* and are disposed annularly inside of the sleeve 1 adjacent the step corners of the sleeve and define central openings which are located coaxial to the sleeve axis, respectively, through which a male connecting member 5 having corresponding steps may be inserted.

Thus, the sleeve 1 constitutes a template (commonly called a jig) and serves inter alia to correctly position the annular contact portions of the cable shoes 3 and 3' adjacent the respective step corners, the corners being defined by the intersecting of the cylindrical wall portions and the adjacent corresponding annular step portions of the sleeve. However, the connecting member for the incoming current can comprise solely the molded member 2 with its steps and its cable shoes, but without the sleeve or template 1.

The larger lowermost step 1*a* of the female connecting member 1, 2 opens toward the outside to permit the insertion of the second male cooperative member of the twist-prevention device, namely the connecting member 5 (FIGS. 3 or 3A) for the outgoing current.

This member 5 as may be seen in FIG. 3 is in the form of an end fitting 5 which also is formed with an outer periphery comprising a stepped section corresponding to the interior section of the sleeve 1. An electrical conductor 6 and 6' is helically wound about each of the two steps 5*b* and 5*a* thereof, corresponding to the position of the steps 1*b* and 1*a* of the sleeve 1 located adjacent and above the cable shoes 3 and 3' respectively. The electrical conductors constitute wires, and the ends of the electrical conductors 6 and 6' traverse the interior of the end fitting 5 substantially parallel to its axis through substantially parallel holes 7 and 7' and project therefrom with projecting ends 8 and 8', respectively.

The narrowmost upper step 5*c* of the end fitting 5 forms an uppermost projection 5*c*' which is provided with an axially threaded hole 9. The narrowmost uppermost step 1*c* of the sleeve 1 (which step 1*c* fits over the step 5*c*) is formed with an axial non-threaded bore 10 (in which the uppermost projection 5*c*' rotatably extends) for the passage of a fixing or setting screw 11, which is screwed into the hole 9 of the end fitting 5 after passing through an enlarged countersunk opening 12 formed in the plastic molded part 2 in communication with the bore 10, in order to rotatably axially join the assembly together (noting FIG. 4).

When the connecting member 5 for the outgoing current is coupled into the connecting member 1, 2 for the incoming current, by insertion into the stepped sleeve 1, both of the helical windings of the conductors 6 and 6' are compressed by the respective annular contact portions of the cable shoes 3 and 3' as may be noted from FIG. 4, and contact is established respectively therewith. Current therefore passes into the cables 4 and 4' from the power supply and out from the conductor ends 8 and 8' respectively which are to be connected to the appliance to be used.

Accordingly the end fitting 5 fits into the sleeve 1 in such a manner that the end fitting can rotate in the sleeve 1 while maintaining constant permanent electrical contact.

The twist-prevention device according to the invention has a very simple manner of construction. The cable shoes 3 and 3' which are connected to the supply cable are introduced into the sleeve 1 and the assembly is molded. The helical conductors 6 and 6' are mounted on the end fitting 5 by introducing their ends 8 and 8' into the respective holes 7 and 7' which are formed in respective steps **5*b* and 5*a* of the sleeve 1, the step 5*a* being formed with an annular recess 5*a'* for securing the conductor 6'. The end fitting 5 is introduced into the molded sleeve 1, 2 and assembled cooperatively therewith by the screw 11 which permits relative rotation of the fitting 5 in the sleeve 1**.

In addition to its simplicity, the twist-prevention device according to the invention has the great advantage of permitting molding in one piece, so that leakage paths are reduced to the greatest possible extent and as a result easy homologation is possible.

Another significant advantage of the twist-prevention device of the present invention is that the connecting members 1, 2 and 5, respectively, can be very easily and rapidly assembled or disassembled, so that only the member 5 need be fixed to the appliance to be used, such as the curling tongs and the like, during their assembly, while the flexible cord with the connecting member 1, 2 need only be connected thereto at the end of the assembly line. Moreover, in the case of damage to the cord, the latter can easily be replaced with the connecting member 1, 2 without touching the appliance. In this respect it is simply disassembled from the connecting member 5 by unscrewing the screw 11.

Reference is made now to the embodiment of FIG. 3A, which has the same reference numerals as that of FIG. 3 to indicate similar features, making repeated description unnecessary. As provided by this embodiment for example, one advantageously could form the lower portion of the peripheral edge or surface of the connecting element 5 with a resilient downwardly widening circular or annular lip **5*a* which is compressed upon the assembling of the connecting member 5 into the connecting member 1, 2. This lip 5' provides improved protection against the entrance of moisture, if necessary, acting as a resilient seal continuously engaging the adjacent interior wall of the lower step 1*a* of the sleeve 1 in the cooperatively operatively inserted position of the members 1, 2 and 5**.

While I have disclosed embodiment examples of the present invention, it is to be understood that these examples are given by example only and not in a limiting sense.

I claim:

1. A twist prevention device for electrical conductors, comprising a first connecting means for receiving incoming current and defining an axis, a second connecting means for transmitting outgoing current from said first connecting means and rotatably mounted relative to said first connecting means, said first and second connecting means being formed with corresponding stepped section means each having an uppermost narrowmost step, and wider steps for permitting easy assembly and disassembly relative to one another, said first connecting means for incoming current includes cable shoes comprising pear-shaped flat members defining planes extending perpendicularly to said axis and each cable shoe including a neck portion extending laterally away from said axis laterally beyond said stepped section means, said neck portion connected to a power supply cable at a poinyt laterally spaced away from said stepped section means and each said cable shoe including an annular contact portion located in stepped position with respect to one another relative to the axis of said first connecting means, said second connecting means for the outgoing current consists exclusively only of two helically wound conductors, each forming a wire spring arranged in stepped position on said wider steps, respectively, of the said second connecting means and separately in contact with said annular contact portions of said cable shoes, respectively, when said first and second connecting means are in the rotatably mounted position, each of said springs constituting an integral wire having a projecting end extending parallel to said axis and extending to outside of said second connecting means, said second connecting means for the outgoing current comprising a male member and including said upper narrowmost step formed with a threaded hole, said first connecting means comprising a stepped female sleeve and including said upper narrowmost step having an axial bore therein coaxially aligned with said threaded hole, said first connecting means being formed with an enlarged opening communicating with said axial bore and forming a screw support surface, a screw member having a screw head rotatably supported on said support surface of said first connecting means and having a screw shank extending screwed into said threaded hole of said second connecting means terminating spaced above apart from said wider steps, so as to permit relative rotation of said first and second connecting means and to prevent relative longitudinal movement.

2. The twist-prevention device, according to claim 1, wherein said first connecting means for the incoming current is molded in one piece of plastic material.

3. The twist-prevention device, according to claim 1, wherein said second connecting means constitutes a male member having a peripheral stepped surface including an outwardly extending resilient annular sealing lip on a widest portion of said stepped surface, said lip compressibly engages an inner adjacent surface of said first connecting means, the latter constituting a female member for receiving said male member therein.

4. The twist-prevention device according to claim 1, wherein each of said wider steps of said first connecting means comprises cylindrical wall portions and annular step portions meeting at corners, said annular contact portions of said cable shoes, respectively, are located adjacent said corners of said wider steps, respectively.

5. The twist-prevention device according to claim 4, wherein said cylindrical wall portions of said first connecting means are formed with cable shoe openings, said neck portions of said cable shoes, respectively, extend laterally through said cable shoe openings, respectively.

6. The twist-prevention device, according to claim 1, wherein said second connection means defines a widest of said wider steps defining an upwardly opening annular recess, said widest step is formed with a longitudinal bore communicating with said recess, said projecting end of one of said springs passes through said longitudinal bore and includes a helical turn mounted in said recess and helically extending upwardly about said second connection means therefrom.

* * * * *